United States Patent [19]

Drexel

[11] 4,348,580

[45] Sep. 7, 1982

[54] ENERGY EFFICIENT FURNACE WITH MOVABLE END WALL

[75] Inventor: Charles F. Drexel, Rolling Hills Estates, Calif.

[73] Assignee: Tylan Corporation, Carson, Calif.

[21] Appl. No.: 147,660

[22] Filed: May 7, 1980

[51] Int. Cl.[3] ..... F27B 5/14; F27D 19/00

[52] U.S. Cl. ..... 219/390; 148/189; 118/50.1

[58] Field of Search ..... 219/390, 413, 497; 13/24, 31 R; 118/50, 50.1, 620, 621; 148/189

[56] References Cited

U.S. PATENT DOCUMENTS

| | | | |
|---|---|---|---|
| 3,299,196 | 1/1967 | Lasch, Jr. | 13/24 |
| 3,311,694 | 3/1967 | Lasch, Jr. | 13/24 |
| 3,370,120 | 2/1968 | Lasch, Jr. | 13/24 |
| 3,387,078 | 6/1968 | Montgomery, Jr. et al. | 13/24 |
| 3,554,162 | 1/1971 | Cota | 148/189 |
| 3,573,116 | 3/1971 | Cohen | 148/189 |
| 3,578,495 | 5/1971 | Pammer et al. | 148/189 |
| 3,852,128 | 12/1974 | Kreuzer | 148/189 |
| 3,852,129 | 12/1974 | Diguet | 148/189 |
| 4,061,870 | 12/1977 | Mizushina | 13/24 |

*Primary Examiner*—Bernard Roskoski

*Attorney, Agent, or Firm*—Nilsson, Robbins, Dalgarn, Berliner, Carson & Wurst

[57] ABSTRACT

A tubular furnace, such as a diffusion furnace, having a temperature controlled central region bounded by end walls heated to the temperature of the central region, at least one of said end walls being movable to and from the outer edge of said central region. By means of a temperature-sensing feed-back circuit, the entire temperature controlled region can be maintained at a predetermined isothermal condition, or a temperature gradient can be maintained by heating one of the end walls to a specified higher temperature and heating the other to a specified lower temperature. A combustor, for example for an exothermic chemical reaction, can be located within a guard heater adjacent one of the end walls.

14 Claims, 2 Drawing Figures

ENERGY EFFICIENT FURNACE WITH MOVABLE END WALL

FIELD OF THE INVENTION

The fields of art to which this invention pertains include the fields of semiconductor material processing and temperature controlled hot wall reactors.

BACKGROUND AND SUMMARY OF THE INVENTION

In the manufacture of semiconducting devices, many processes are carried out in a furnace commonly referred to as a diffision furnace, although such furnaces are not limited to diffusion operations. A typical furnace consists of an openened elongate round or rectangular tube. An electrical heating element surrounds the tube, and may be formed with independently controlled sections to maintain a desired temperature profile in a region defined by the central portion of the tube. Such a tube will usually have a necked-down end to accept one or more input tubes carrying gases, the opposite end being open to a scavanger member for exhaust of the process gases.

In a typical process, a number of semiconductor wafers (e.g., thin slices of single crystal silicon) are placed in a carrier, called a boat, either in substantially vertical or substantially horizontal position and the boat is inserted into the central region of the furnace. Process gases are introduced in one end, pass over the wafer and exhaust out the other end. The hot reacting wafers are extremely sensitive to impurities; a few hundred parts per billion of certain elements, for example sodium, can "poison" a load of semiconductors so that they are useless. To minimize exposure of the wafers to such impurities, diffusion furnaces are typically lined with quartz.

To assure uniformity of composition of the semiconductor and therefore reproducibility of desired properties, it is essential that each wafer react identically to every other wafer in the furnace, and that each load of wafers reacts identically to every other load. Typically, this requires a region of isothermal temperature. Generally it is desired to maintain a central "flat" zone isothermal to within ±0.5° C. or better. In some chemical processes, the rate of chemical reaction can vary as much as 1.5% per °C. whereas variations in end product of more than ±5% are generally unacceptable in modern semiconductor devices. To achieve uniform reaction, standard furnaces have a helically wound resistance heating element surrounding the quartz tube that is divided into three sections by standoff connections welded into the element: a central heater surrounding the central region, and two independently controlled guard heaters, one at each end. In conventional operation the guard heaters are set at temperatures somewhat higher than the temperature set for the central heater, thereby compensating for heat loss through the open ends of the tube, and promoting an isothermal region in a portion of the central section of the tube. A furnace constructed in such a manner must have a large length to diameter ratio, e.g. about 10–15, in order to create a useable isothermal region. Such a furnace therefore requires not only large amounts of floor space but also is excessively energy intensive, because a substantial portion of the furnace is heated above the desired operating temperature of the isothermal region.

The present invention provides a furnace which can achieve an isothermal region with a tube having a low length to diameter ratio, without use of excessive amounts of energy. More particularly, in accordance with one aspect of the present invention, a pair of end walls are located at opposite ends of an elongate chamber in which there is a temperature controlled isothermal region. Means are provided for heating the temperature controlled region to the desired isothermal temperature and the end walls are independently heated by guard heater sections of the heating element such that their temperature is maintained at substantially the same temperature as the temperature controlled region. This results in the entire length of the temperature controlled region being isothermal. At least one end wall is movable to facilitate loading and unloading of the furnace.

Temperature control is achieved by placing a thermoelectric sensing device centrally of the temperature controlled region for feed-back control of the central heater section. The temperature of each end wall is controlled by two thermoelectric sensors, one disposed substantially centrally of the temperature controlled region, and one disposed in the proximal outer edge of the temperature controlled region, which may be substantially in the plane of the end wall. In operation, the temperature levels of the end walls are controlled so as to be maintained at the temperature of the central region, i.e., a zero "delta T" operation.

In accordance with another aspect of the invention, for some operations when a temperature gradient is desired, one end wall can be heated to a specified temperature above the central region, and the other end wall heated to the same temperature below the central region, i.e., commanding a positive delta T for one guard heater and a negative delta T for the other guard heater.

In a further embodiment, a combustor, i.e. a chemical reactor, can be located within one of the guard heater sections; in this case the wall on that end is located at the outer end of the guard heater. The present invention permits an exothermic reaction to take place in the combustor without destroying the desired temperature profile of the central region. This results from feed-back control of the end walls relative to the central heater; the sensor adjacent the combustor is heated by the combustor so that only that amount of electrical current is fed to the adjacent guard heater to bring that guard heater up to the desired temperature.

By using the present invention, the electrical consumption of a diffusion operation is estimated to decrease by 6 kilowatt hours per tube compared to a typical commercial operation. Additionally, the tube and associated equipment occupy a substantially smaller space, about 35% less than competitive equipment. Not only is there a savings in size and in direct energy requirements but because of the small size of the tube, smaller and therefore less expensive electrical power supplies and components can be used. Radiant heat losses are reduced thereby lowering electrical requirements for air conditioning and cooling water.

DETAILED DESCRIPTION

Figure 1:
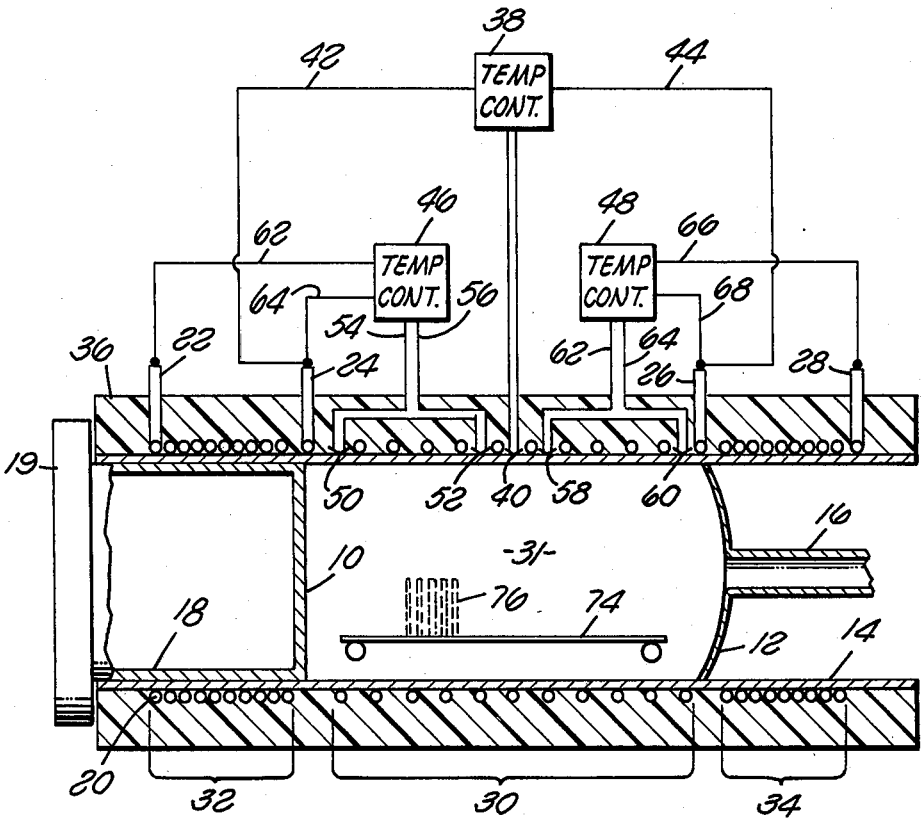
FIG. 1 is a schematic cross-sectional view of a tubular furnace of the present invention.

Referring to FIG. 1, a tubular diffusion furnace is shown having a central region defined by opposite first and second walls 10 and 12. The interior of the furnace is lined by a quartz tube 14 that is curved and necked-down at one end of the furnace to a smaller diameter tube 16. A tubular closure member 18 of slightly smaller outer diameter than the inner diameter of the quartz tube 14 is coaxially disposed in the other end of the quartz tube 14. The inner end of the tubular closure member 18 is closed to define the first end wall 10 as a vertically planar surface and is formed at its outer end with a lip 19 that closes with the end of the outer edge of the furnace. The curved end portion of the quartz tube 14 defines the second end wall 12 fixed at a predetermined position. In this embodiment, the second end wall 12 is located adjacent to the central region, i.e., at the inner end of the guard heater to be described. The first end wall 10 and the coaxially disposed tubular member 18 to which it is attached are movably mounted within the quartz furnace tube 14 to allow easy removal for loading and unloading the furnace.

The tubular furnace is provided with a helical heater element 20 made by winding a continuous spiral coil of electrical resistance wire on a mandrel, then welding taps for electrical connectors, in accordance with prior art practice. The helical heating element 20 is constructed and placed on the quartz tube 14 so that it surrounds the entire quartz tube 14, extending past both end walls 10 and 12. The heating element 20 is divided into three discrete sections by four standoff connections 22, 24, 26 and 28 welded to the heating element 20. That section of the heating element 20 between the two middle standoff connections 24 and 26 constitutes a central heating section 30 which defines the temperature controlled region 31 of the diffusion furnace. The sections of the heating element 20 between each of the outer standoff connections 22 and 28 and the inner standoff connections 24 and 26, respectively, comprise guard heaters 32 and 34, respectively. The central heater section 30 and the guard heaters 32 and 34 are capable of independent electrical power control to provide independent resistance heating. The entire furnace is kept thermally isolated from the environment by an insulating housing 36.

The temperature of the central heater element 30 is controlled by a first temperature controller 38 connected to a central thermocouple 40 disposed centrally in the temperature controlled region 31. In response to the temperature sensed by the central thermocouple 40, the first temperature controller 38 varies electrical power to the central heater element 30 through leads 42 and 44 connected to the middle two standoff connections 24 and 26, respectively.

The electrical power inputs to both guard heaters 32 and 34 are controlled by second and third temperature controllers 46 and 48, respectively. Each guard heater controller 46 and 48 is connected to a pair of thermocouples 50, 52 and 58, 60 disposed within the temperature controlled region 31 and connected to each other in series. One thermocouple in each pair is disposed adjacent to the central thermocouple 40 and the other is disposed at the end of the temperature controlled region 31. Accordingly, in the embodiment of FIG. 1, the thermocouples are substantially in the planes of the end walls during operation of the furnace. All three temperature controllers, 38, 46 and 48 are connected to an outside power source that provides power for heating the resistance heating elements 30, 32 and 34.

More specifically, the second temperature controller 46 is attached by leads 62 and 64 to the standoff connectors 22 and 24 across the guard heater 34, thereby controlling the electrical energy to that guard heater 34 serving to heat the movable end wall 10. In a similar manner, the third temperature controller 48 is attached by leads 66 and 68 to the standoff connectors 26 and 28 across the guard heater 32, thereby controlling electrical energy to that guard heater 32, serving to heat the fixed end wall 12. One pair of thermocouples 50, 52 is connected in series to the second temperature controller 46 by leads 54 and 56, respectively. Similarly, the other pair of thermocouples 58, 60 are connected in series to the third temperature controller 48 by leads 62 and 64, respectively. As above indicated, one thermocouple of each pair is disposed substantially in the center of the controlled zone 31 while the other thermocouple of each pair is disposed substantially at the end of the temperature controlled region 31. In this manner, one obtains feed-back information on the temperature difference between the end walls 10 and 12 and the center of the temperature controlled region 31.

The second and third temperature controllers 46 and 48 can be set to maintain a desired specified temperature difference between the center of the temperature controlled region 31 and the end walls and to vary electrical energy to the guard heaters 32 and 34 to maintain the temperature difference. To provide an isothermal region 31, the controllers are set to provide for a zero temperature difference, i.e., the delta T is equal to zero. In some operations, it is desirable to have a temperature gradient from one end wall to another. Such a "tilted" temperature profile can be created by maintaining a temperature difference between the center of the temperature controlled region 31 and the two end walls 10 and 12. For example, if a temperature gradient of 20 C.° is desired, the center of the furnace is heated to the average value desired. Then one end wall 10 is maintained at a negative delta T of 10° C. below the center temperature, while the other end wall 12 is maintained at a positive delta T of 10° C. above the center temprature, producing a temperature gradient from one end wall to the other.

In operation, the tubular closure member 18 initially is removed from the furnace tube 14 and a boat 74 containing wafers 76 to be processed is placed within the furnace tube 14. The tubular closing member 18 is then inserted into the furnace tube 14 to a depth, limited by the lip 19, where the planar surface of the end wall 10 is substantially in the same plane as the proximal outer thermocouple 50. The first temperature controller 38 is set to provide the desired operating temperature and the other two temperature controllers 46 and 48 are set to provide the desired temperature difference (for isothermal operation, the difference would be zero) between the center 31 of the furnace and the end wall 10 and 12. As the furance heats up, the guard heaters 32 and 34 provide heat to the end walls 10 and 12 to maintain the set temperature difference. When the desired operating temperature has been reached, and the walls 10 and 12 are at the desired temperature difference, processed gas is allowed to pass through the necked-down portion 16 of the tube in the temperature controlled region 31 of the furnace where it reacts with the wafers 76. In this regard, one may use any convenient arrangement, as known to the art to inject and evacuate process gas, or one can use one or more conduit tubes to carry gas into and out of the furnace tube 14. During processing, the temperature of the temperature controlled region 31 is maintained by the central heating element 30. The central thermocouple 40 allows the first temperature controller 38 to maintain the central region to within a small temperature tolerance, less than 0.5° C. Temperature difference at the end walls 10 and 12 are detected by the respective thermocouples 50, 52, 58 and 60 and, in response to any differences, the controllers 46 and 48 vary the electrical energy to the guard heaters 32 and 34. In such manner, the electrical energy to the guard heaters 32 and 34 is constantly automatically adjusted to minimize temperature fluctuations.

Temperature controllers as defined herein are devices that can vary electrical power to resistance heating elements in response to electrical feedback from thermoelectric temperature sensors. In the case where the thermoelectric temperature sensor is a thermocouple, the EMF generated by the thermocouple at a given temperature is detected and the electrical power to the resistance heating element is varied in response. Other thermoelectric temperature sensing devices can be used, e.g. resistance thermometers.

Figure 2:
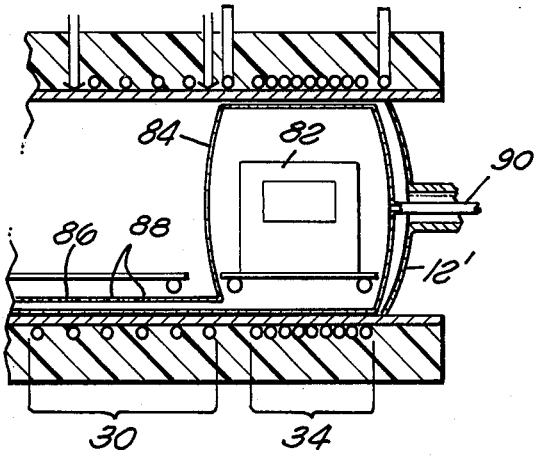
FIG. 2 is a schematic crosssectional view of one end of a tubular furnace with an exothermic chemical reactor placed within.

Referring to FIG. 2, there is shown a combustor 82, e.g. an exothermic chemical reactor, disposed within the furnace tube 14 adjacent the fixed end wall 12'. In this embodiment, the fixed end wall 12' is located adjacent the outer coil of the guard heater 34 to provide room for the combustor 82. The combustor 82 is enclosed by quartz envelope 84 which communicates with the inside of the furnace by means of an elongate manifold tube 86 formed with a plurality of apertures 88 along its length. All other components are the same as illustrated with respect to FIG. 1. As process gases react exothermically within the combustor 82, the associated temperature controller 48 reduces electrical power to the guard heater 34 in response to heat created by the exothermic reaction. In this manner, the temperature profile of the isothermal region can be maintained even though heat is generated by an exothermic combustion reaction. More specifically, in operation of the embodiment of FIG. 2, process gases to be reacted exothermically, for example hydrogen and oxygen, are introduced into the combustor 82 through a tube 90 leading to the combustor 82. As the gases react, creating heat, the temperature controller 48 provides only that amount of electrical energy to the guard heater 34 to obtain the desired temperature.

The function of the guard heaters 32 and 34 in this invention is to heat the end walls rather than to make up for heat losses through the ends of the furnace tube. In this manner, in isothermal operation, no portion of the furnace is ever heated substantially above the operating temperature of the temperature controlled region 31. Because the entire region between the end walls is usable temperature controlled space, a furnace constructed in accordance with this invention can have a much smaller length to diameter ratio, e.g. less than 6:1, than would be possible if the end wall heaters made up for heat losses.

It should be understood that although this invention is directed towards diffusion furnaces for semiconductor operations, the furnace can be used for other purposes such as chemical vapor deposition, epitaxy and other microelectronic processing, and can be readily adapted, by one skilled in the art, for use at reduced pressure.

I claim:

1. A furnace, comprising:

a first tubular member having opposite first and second ends, said tubular member being open on at least said first end and defining an elongate chamber having an elongate inner section spaced inwardly from said open end and at least a first outer section terminating at said first end;

means for introducing process gas through said second end;

means for separately heating said inner and outer sections, comprising means for heating said elongate inner section and a guard heater on said first outer section for heating a substantial portion of said first outer section;

means for closing said open end, comprising a first wall normal to the axis of said tubular member disposed in the open end of said tubular member, said wall being movable to and from a position in said first outer section that is adjacent the outer edge of said inner chamber section;

means for sensing a differential in temperature between a central portion of said inner chamber section and the outer edge of said inner chamber section proximal to said open end; and means for varying the extent of heating of said first outer section in accordance with said sensed temperature differential to provide a predetermined temperature relationship between said first outer chamber section and said inner chamber section.

2. The furnace of claim 1 in which said first wall is carried on a second tubular member formed to slidably move in the open end of said first tubular member.

3. The furnace of claim 1 including:

a second wall on said second end of said first tubular member opposite said open end;

means for heating a second outer section of said chamber adjacent said second end;

means for sensing a differential in temperature between a central portion of said inner chamber section and the outer edge of said inner chamber section proximal to said second end; and means for varying the extent of heating of said second outer section in accordance with said temperature differential to provide a predetermined temperature relationship between said second outer chamber section and said inner chamber section.

4. The furnace of claim 3 in which said second wall is formed with an outwardly extending horizontally disposed tubular member defining an opening therethrough for constituting said means for introducing process gas.

5. The furnace of claim 3 in which said second wall is disposed substantially in the plane of the proximal outer edge of said inner chamber section.

6. The furnace of claim 3 in which said second wall is disposed at a position spaced outwardly from the plane of the proximal outer edge of said inner chamber section and further including a chemical reactor disposed between said second wall and the plane of the proximal outer end of said inner chamber section.

7. The furnace of any one of claims 1–5 in which said predetermined temperature relationship is isothermal.

8. The furnace of any one of claims 1–5 in which said means for heating said inner and outer sections comprise spirally wound electrical resistance wire on said tubular member.

9. The furnace of claim 8 including a jacket of heat insulating material encasing said tubular member.

10. A furnace, comprising:

a first tubular member, open on one end and formed with a fixed wall at the opposite and to define an elongate chamber between said ends into which can be inserted a plurality of units of semiconductor material to be contacted with process gas, said elongate chamber having an inner section, an outer section terminating outwardly at said open end, and an outer section terminating inwardly at said fixed wall, said fixed wall being formed with an outwardly extending horizontally disposed tubular member defining an opening therethrough for the introduction of process gas;

spirally wound electrical resistance wire on said tubular member and electrically connected to separately heat said inner section and said outer sections;

a closure for the open end of said first tubular member, comprising a second tubular member and a wall carried thereon formed to slidably move in said open end to substantially close said open end, said wall being movable to and from a portion of said outer section thereat adjacent the proximal outer edge of said inner chamber section;

thermoelectric members placed centrally of said inner chamber and at the outer edges thereof, arranged to sense differentials of temperature between a central portion of said inner chamber section and the outer edges of said inner chamber section; and means for varying the extent of heating of said outer sections in accordance with said sensed temperature differentials to provide a predetermined temperature relationship between said inner and outer chamber sections.

11. The furnace of claim 10 in which said predetermined temperature relationship is isothermal.

12. The furnace of claim 6 in which said predetermined temperature relationship is isothermal.

13. The furnace of claim 6 in which said means for heating said inner and outer sections comprise spirally wound electrically resistance wire on said tubular member and electrically connected for separate heating of said inner and outer sections.

14. The furnace of claim 13 including a jacket of heat insulating material encasing said tubular member.

* * * * *

UNITED STATES PATENT AND TRADEMARK OFFICE

CERTIFICATE OF CORRECTION

PATENT NO. : 4,348,580

DATED : September 7, 1982

INVENTOR(S) : Charles Drexel

It is certified that error appears in the above-identified patent and that said Letters Patent are hereby corrected as shown below:

Col. 1, line 16, change "openened" to --open-ended--.

Col. 4, line 43, change "temprature" to --temperature--.

Col. 7, line 5, change "and" to --end--.

Signed and Sealed this

*Twenty-seventh* Day of *September 1983*

[SEAL]

*Attest:*

GERALD J. MOSSINGHOFF

*Attesting Officer*

*Commissioner of Patents and Trademarks*